US007493712B2

(12) United States Patent
McCormick et al.

(10) Patent No.: US 7,493,712 B2
(45) Date of Patent: Feb. 24, 2009

(54) EXCAVATOR TOOL QUICK ATTACHMENT DEVICE

(76) Inventors: Patrick McCormick, Oldcastle, County Meath (IE); Caroline McCormick, Oldcastle, County Meath (IE); Martin Segarty, Oldcastle, County Meath (IE); William Egenton, Oldcastle, County Meath (IE)

( * ) Notice: Subject to any disclaimer, the term of this patent is extended or adjusted under 35 U.S.C. 154(b) by 28 days.

(21) Appl. No.: 10/571,634

(22) PCT Filed: Sep. 20, 2004

(86) PCT No.: PCT/IE2004/000128

§ 371 (c)(1),
(2), (4) Date: Jan. 16, 2007

(87) PCT Pub. No.: WO2005/026454

PCT Pub. Date: Mar. 24, 2005

(65) Prior Publication Data

US 2007/0199214 A1 Aug. 30, 2007

(30) Foreign Application Priority Data

Sep. 18, 2003 (IE) ..... S2003/0685
Mar. 26, 2004 (IE) ..... S2004/0194

(51) Int. Cl.
*E02F 3/96* (2006.01)

(52) U.S. Cl. ..... 37/468

(58) Field of Classification Search ..... 37/403, 37/404, 405, 406, 407, 408, 409, 410, 468, 37/903; 414/723
See application file for complete search history.

(56) References Cited

U.S. PATENT DOCUMENTS

| | | | | |
|---|---|---|---|---|
| 3,654,833 | A | 4/1972 | Griffiths | |
| 4,726,731 | A * | 2/1988 | Jones | 414/723 |
| 5,082,389 | A | 1/1992 | Balemi | |
| 5,692,325 | A | 12/1997 | Kuzutani | |
| 6,132,130 | A | 10/2000 | McCann | |
| 6,422,805 | B1 | 7/2002 | Miller | |
| 6,699,001 | B2 * | 3/2004 | Fatemi | 414/723 |
| 6,962,475 | B2 * | 11/2005 | Fatemi | 414/723 |
| 6,964,122 | B2 * | 11/2005 | Cunningham et al. | 37/468 |
| 7,198,451 | B2 * | 4/2007 | Wimmer | 414/723 |
| 2002/0071754 | A1 | 6/2002 | Fatemi | |

FOREIGN PATENT DOCUMENTS

| | | |
|---|---|---|
| DE | 198 06 057 | 9/1999 |
| DE | 201 19 092 | 1/2002 |
| EP | 0405813 A2 | 1/1991 |
| EP | 0769590 A2 | 4/1997 |
| EP | 1 318 242 A2 | 6/2003 |

(Continued)

*Primary Examiner*—Gary S Hartmann
(74) *Attorney, Agent, or Firm*—Hoffman & Baron, LLP

(57) ABSTRACT

Excavator tool quick attachment device (1) is used to attach a tool to a dipper arm (2) of an excavator. Body member (52) has two receivers (12,14) for tool pins (11,15). Receiver (12) has a movable latch (3) powered by an hydraulic ram (20) for securing and releasing pin (11) and receiver (14) has a movable spring loaded lock (22) for securing and releasing pin (15). A control assembly (21) is connected between latch (3) and lock (22) but only operates to release lock (22) when the device (1) is inverted relative to a normal working position and the hydraulic ram (20) is activated.

8 Claims, 13 Drawing Sheets

FOREIGN PATENT DOCUMENTS

| | | | |
|---|---|---|---|
| EP | 1254287 | B1 | 11/2004 |
| FR | 2701047 | | 8/1994 |
| FR | 2776316 | | 9/1999 |
| GB | 2335649 | | 9/1990 |
| GB | 2238035 | | 5/1991 |
| GB | 2330569 | | 4/1999 |
| GB | 2 332 417 | A | 6/1999 |
| JP | 06264466 | | 9/1994 |
| WO | WO9942670 | | 8/1999 |

* cited by examiner

EXCAVATOR TOOL QUICK ATTACHMENT DEVICE

This application is the U.S. National Phase of International Application Number PCT/IE2004/000,128 filed on 20 Sep. 2004, which is incorporated herein by reference.

BACKGROUND OF THE INVENTION

The present invention relates to an excavator tool quick attachment device and more particularly to a safety mechanism for an excavator tool quick attachment device.

Pneumatic/hydraulic latches on quick attachment devices are well known and are generally mounted on a tool engaging portion which has two hooks, one of which is on each end of the device. The excavator operator locates one of the hooks around the first pin of the tool and raises a dipper arm of the excavator. The rams of the dipper arm are manipulated until the second hook is located adjacent the second pin of the tool and a pneumatic/hydraulic latch comprising a hydraulic/pneumatic piston connected between the attachment device and the latch is actuated to lock the second pin of the tool onto the quick attachment device.

The problem with this latch is that failure of the hydraulic/pneumatic cylinder could result in the latch opening and allowing the tool such as a bucket to become separated from the quick attachment device with potentially disastrous consequences for anyone in the vicinity. A number of safety pins and other safety mechanisms have been developed but most of these require to be inserted manually. Further secondary safety systems utilising hydraulic systems have also been developed which add extra system maintenance and expense.

It is an object of the present invention to overcome the need for manually operable safety pins or complex hydraulic systems, both of which are used to prevent unintended release of the tool from the quick attachment device.

SUMMARY OF THE INVENTION

Accordingly, the present invention provides an excavator tool quick attachment device for attaching a tool to a dipper arm of an excavator, the device comprising a body member with an engaging means at or about each end for engagement with two connecting pins disposed on a tool, the first engaging means being a movable engaging means, the device further comprising a drive means mounted between the body member and the movable engaging means for moving the movable engaging means between a tool pin engaging position and a tool pin releasing position, the second engaging means being a second movable engaging means normally biased into a tool pin engaging position by a biasing means, a control means mounted between the first movable engaging means and the second movable engaging means, wherein the control means acts on the second movable engaging means to overcome the biasing force only when the quick attachment device is inverted relative to a normal working position and the drive means is actuated, whereby the tool can not be released when it is in a normal working position in the event the drive means fails or is inadvertently actuated by an operator.

The quick attachment device being in an inverted position is commonly referred to in the art as the crouched or valueless position.

Preferably, the control means comprises an adjustable length actuating assembly having a catch means to fix the length of the actuating assembly at a predetermined position when the quick attachment device is inverted relative to a normal working position and the drive means is actuated. Advantageously, the use of mechanical components powered by an already present drive means reduces the complexity and cost of a secondary safety mechanism.

Ideally, the actuating assembly is pivotally connected to both movable engaging means.

Preferably, the actuating assembly is in two parts, the first part having a slot extending along a substantial portion of its longitudinal axis and the second part having two pins spaced apart along its length and extending laterally therefrom, the pins being formed for slidable engagement with the slot of the first part, allowing relative movement between the two parts, the pins movably holding the two parts together.

Ideally, the catch means is provided by a notch on the slot which is located above the pins in any normal working position of the tool and the slot is located below the pins only when the quick attachment device is inverted relative to the normal working position.

Preferably, when the quick attachment device is inverted and the drive means is actuated to move the first movable engaging means from a tool pin engaging position to a tool pin releasing position, the pins of the second part of the actuator assembly slide along the slot until the leading pin encounters the notch into which it drops under the force of gravity thereby fixing the length of the actuating assembly after which point continued stroke action of the drive means causes the actuating assembly to move the second movable engaging means away from the tool pin engaging position thereby releasing that tool pin.

Ideally, the first movable engaging means is provided by a pair of latch hooks pivotally mounted on the body.

Preferably, the second movable engaging means is provided by a lock pivotally mounted on the body.

Ideally, the drive means is a double acting piston and cylinder unit.

Advantageously, the excavation tool quick attachment device includes a tilt mechanism by means of which the device can be titled about a longitudinal pivotal axis.

This invention will now be described with reference to the accompanying drawings which show, by way of example only, two embodiments of an excavator tool quick attachment device in accordance with the invention.

DETAILED DESCRIPTION OF THE INVENTION

Figure 1:
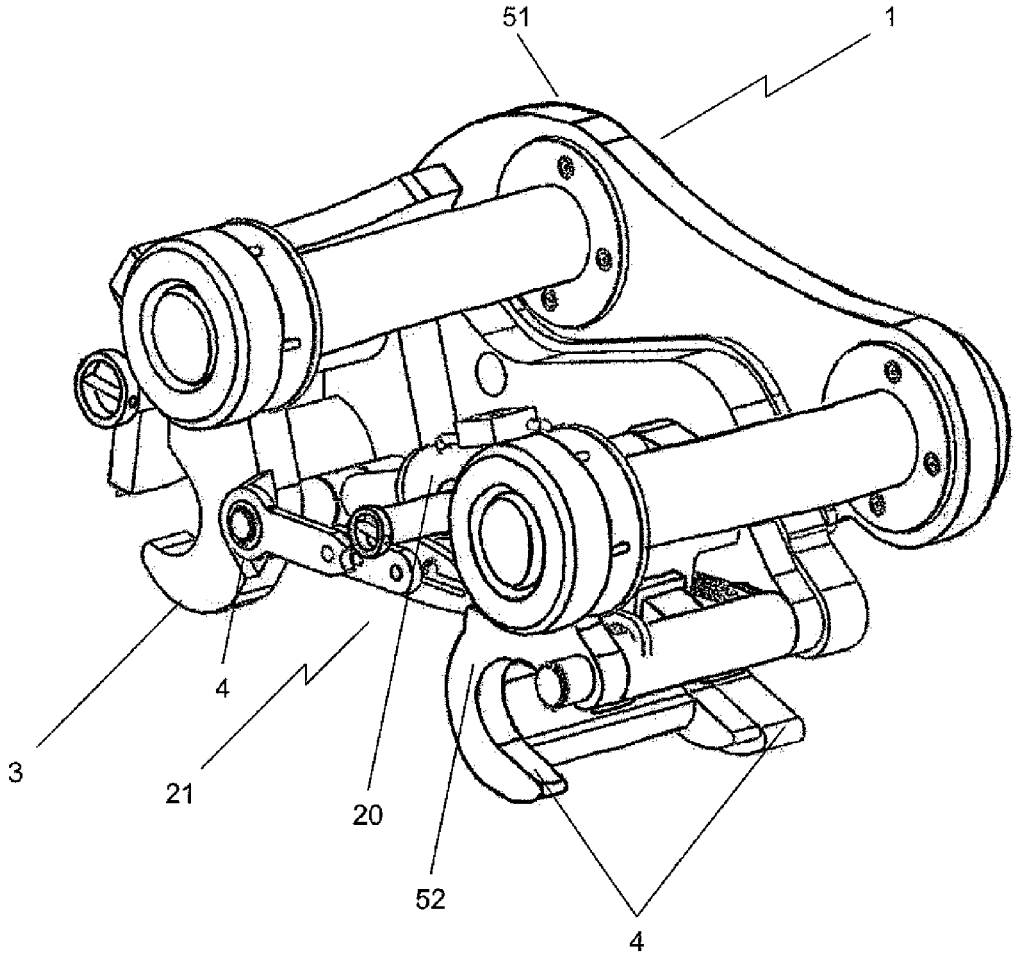
FIG. 1 is a perspective view of a first embodiment of a quick attachment device with a left side plate removed.
Figure 1A:
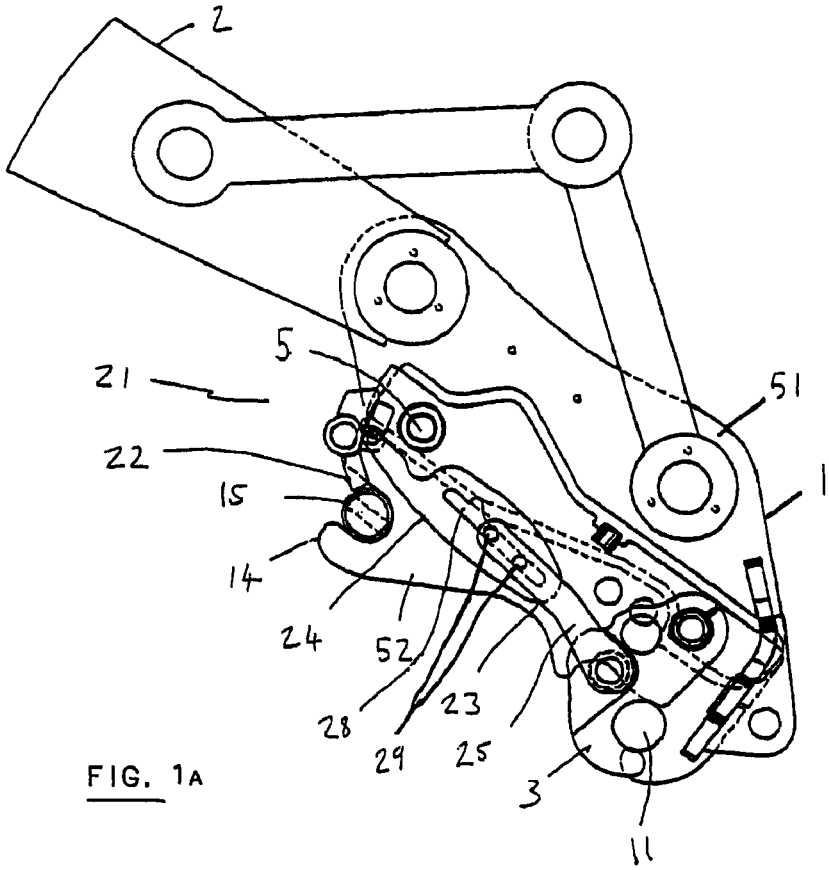
FIG. 1*a* is a side view of the first embodiment of a quick attachment device mounted on a dipper arm of an excavator in a normal working position.

Referring to the drawings, FIGS. 1 to 4 show an excavator tool quick attachment device 1 mounted on an excavator dipper arm 2 and FIGS. 5 to 8 show detail views of the safety mechanism 21 mounted on the quick attachment device 1. The quick attachment device 1 is of the type having a dipper arm engaging portion 51 and a body portion 52 having receivers or mouths 12, 14 for receiving tool pins 11, 15 respectively. The device 1 also has two latch plates 3 (one shown) spaced apart and being pivotally connected to the body portion 52 of the attachment device 1 by pivot pin 6. A hydraulic ram 20 is connected between heels 4 of the latch plates 3 and shaft 5. Actuation of the ram 20 causes the latch plates 3 to pivot about pin 6 locking or releasing tool pin 11 between a concave potion of the latch plates 3 and a concave portion of mouth 12 of the attachment device 1. The attachment device 1 has a second mouth 14 for engaging the other tool pin 15 at the opposite end of the device 1. A safety mechanism indicated generally by the reference numeral 21 (see FIGS. 5 to 8 in particular) is shown having a lock 22 pivotally mounted adjacent the mouth 14 and a two-part actuating assembly 23. A first part 24 of the actuating assembly 23 is pivotally connected to the lock 22 and the second part 25 of the actuating assembly 23 is pivotally connected to latch plate 3. The first part 24 of the actuating assembly 23 has a slot 28 extending along a substantial portion of its length. The second part 25 has two pins 29 extending transversely therefrom and movably connecting the first and second parts 24, 25 together with the pins 29 being formed for slidable movement along the slot 28 in response to actuation of the hydraulic ram 20 to pivot the latch plates 3. The slot 28 has a notch 32 above the pins 29 in a normal working position and below the pins 29 in the inverted position.

Figure 2:
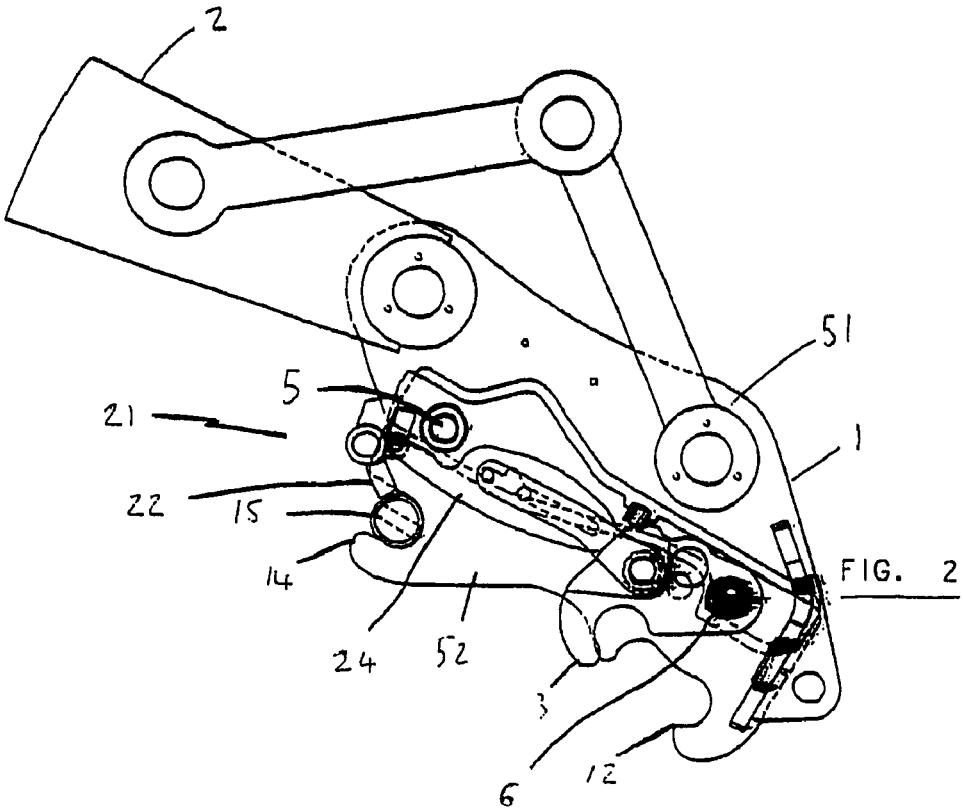
FIG. 2 is a second side view of the quick attachment device with a latch in an open position.
Figure 5:
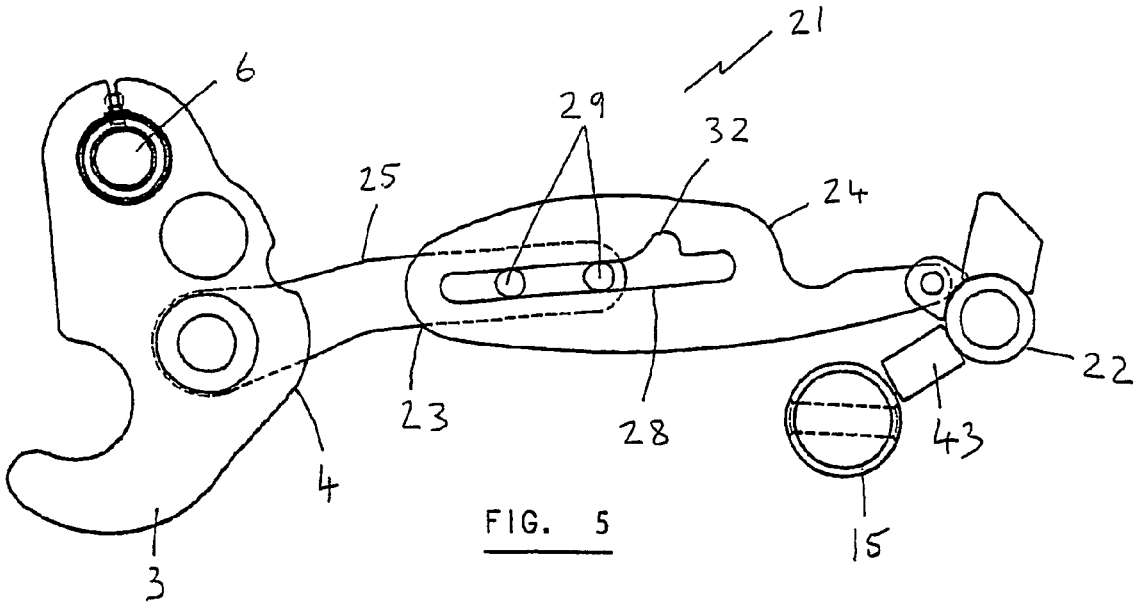
FIG. 5 is a detail view taken from the opposite side as the views of FIGS. 1 to 4 of the safety mechanism in a normal working position.
Figure 6:
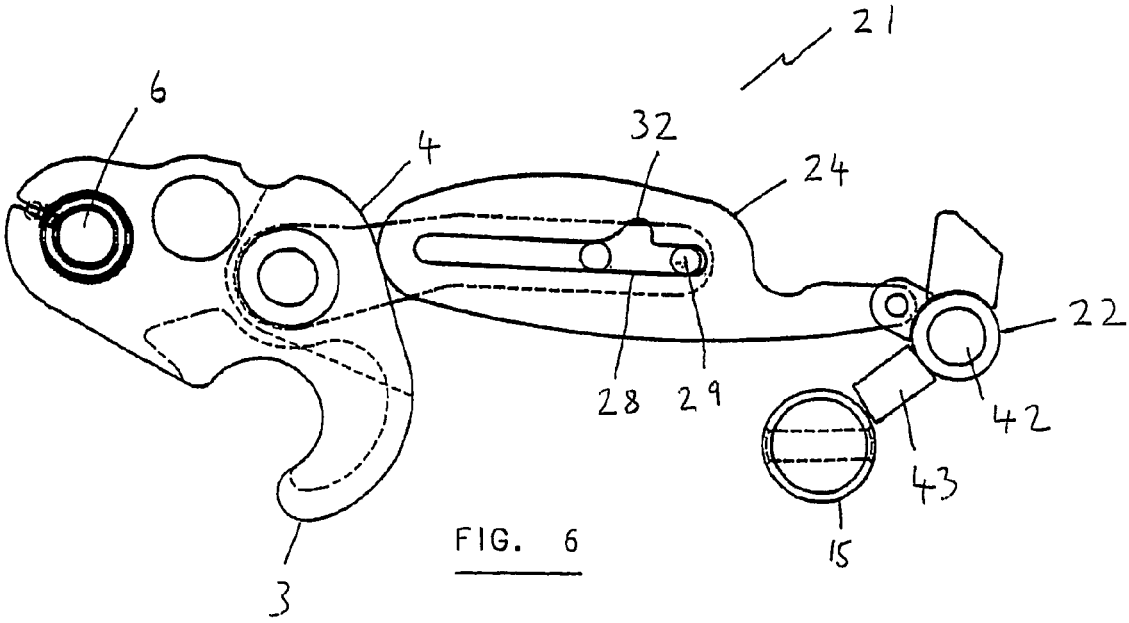
FIG. 6 is a second detail view of the safety mechanism of FIG. 5 in a second working position.

In use and referring to FIG. 1 and FIG. 5, the latch plates 3 are pivoted into a pin 11 engaging position and lock 22 is biased into a pin 15 engaging position by a biasing element, such as a spring (not shown). In FIG. 2 and FIG. 6, the latch plates 3 are pivoted into a tool pin 11 releasing position by the ram. This could be an intentional actuation or it could have come about as a result of ram failure or inadvertent actuation by an operator. Due to the forces of gravity acting on the free end of the second part 25 and the free end of the first part 24 of the actuating assembly 23 the pin 29 adjacent the free end of the second part 25 slides past the notch 32. The complete rotation of the latch plates 3 causes the pin 29 adjacent the free end of second part 25 to slide to an area just before the end of the slot 28. No force is exerted on the lock 22 by the actuating assembly 23 therefore the lock 22 prevents the second tool pin 15 from becoming released unintentionally when the quick attachment device 1 is in a normal working position.

Figure 3:
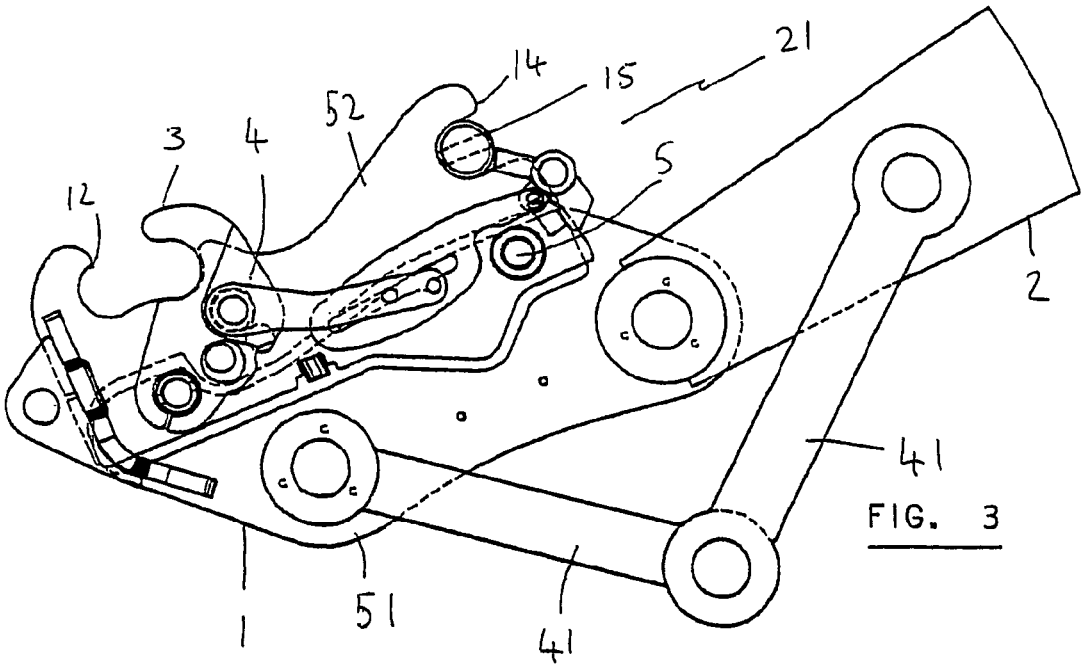
FIG. 3 is a side view of the quick attachment device in an inverted position.
Figure 7:
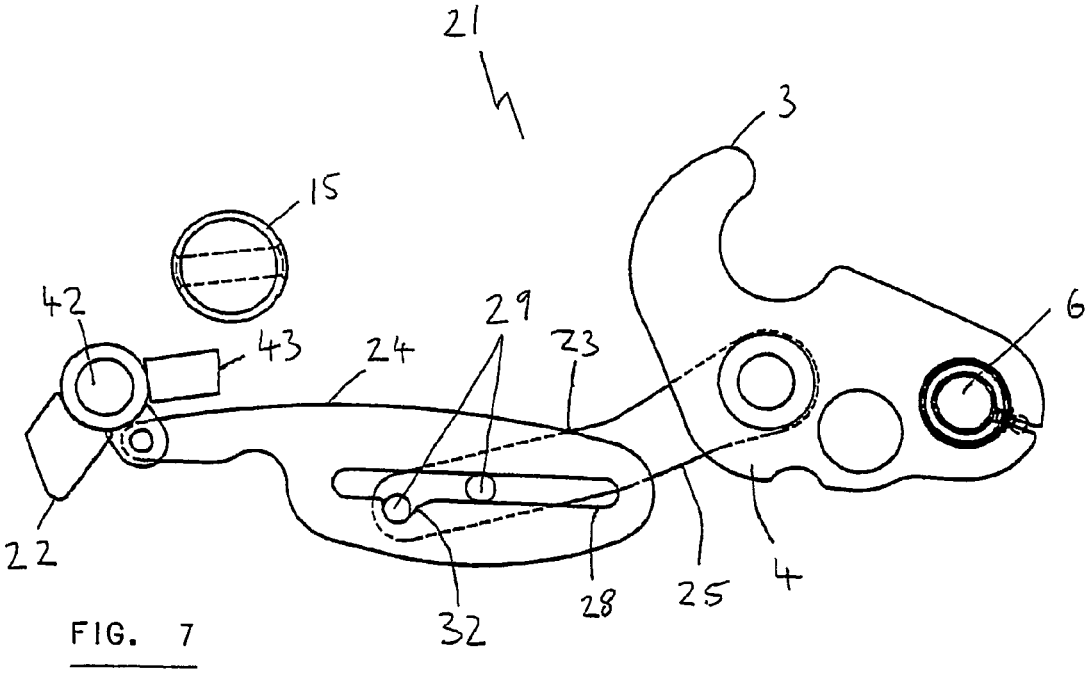
FIG. 7 is a third detail view of the safety mechanism of FIG. 5 and FIG. 6 in an uncoupling position.

In FIG. 3 and FIG. 7, the dipper arm 2 of the excavator has been pulled in towards the excavator and the hydraulic rams 41 of the dipper arm 2 have been activated so that the longitudinal axis of the quick attachment device 1 has been rotated clockwise through 180° into the inverted position compared to FIGS. 1 and 2. The hydraulic ram (not shown) is activated and the pins 29 slide along the slot 28. However, due to the rotation of the attachment device 1, the notch 32 is now located below the pins 29. The first pin 29 adjacent the free end of the second part 25 drops down into the notch 32 again due to gravitational force and abuts against the notch 32. At this point, the lock 22 is still engaging the tool pin 15.

Figure 4:
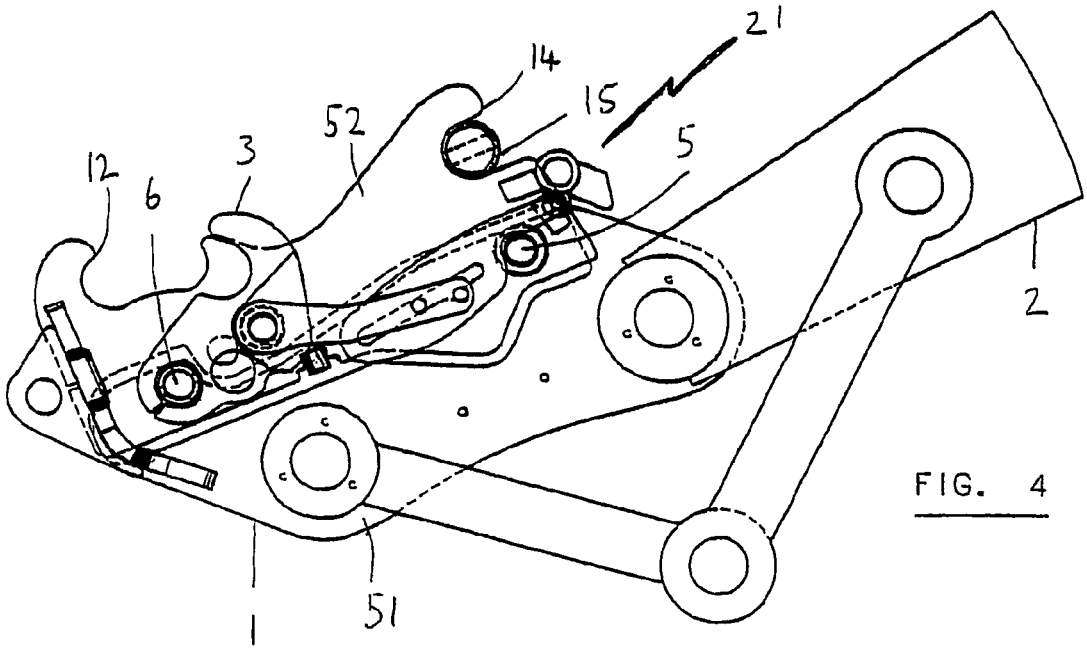
FIG. 4 is a second side view of the quick attachment device in an inverted position showing the safety mechanism in an open position.
Figure 8:
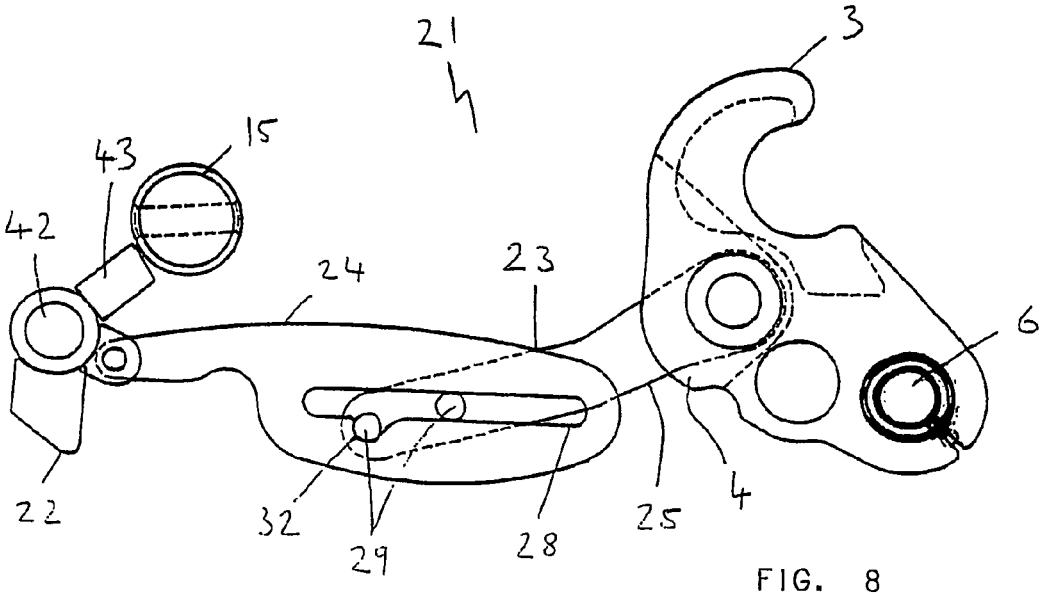
FIG. 8 is a fourth detail view of the safety mechanism in an uncoupled position.
Figure 9:
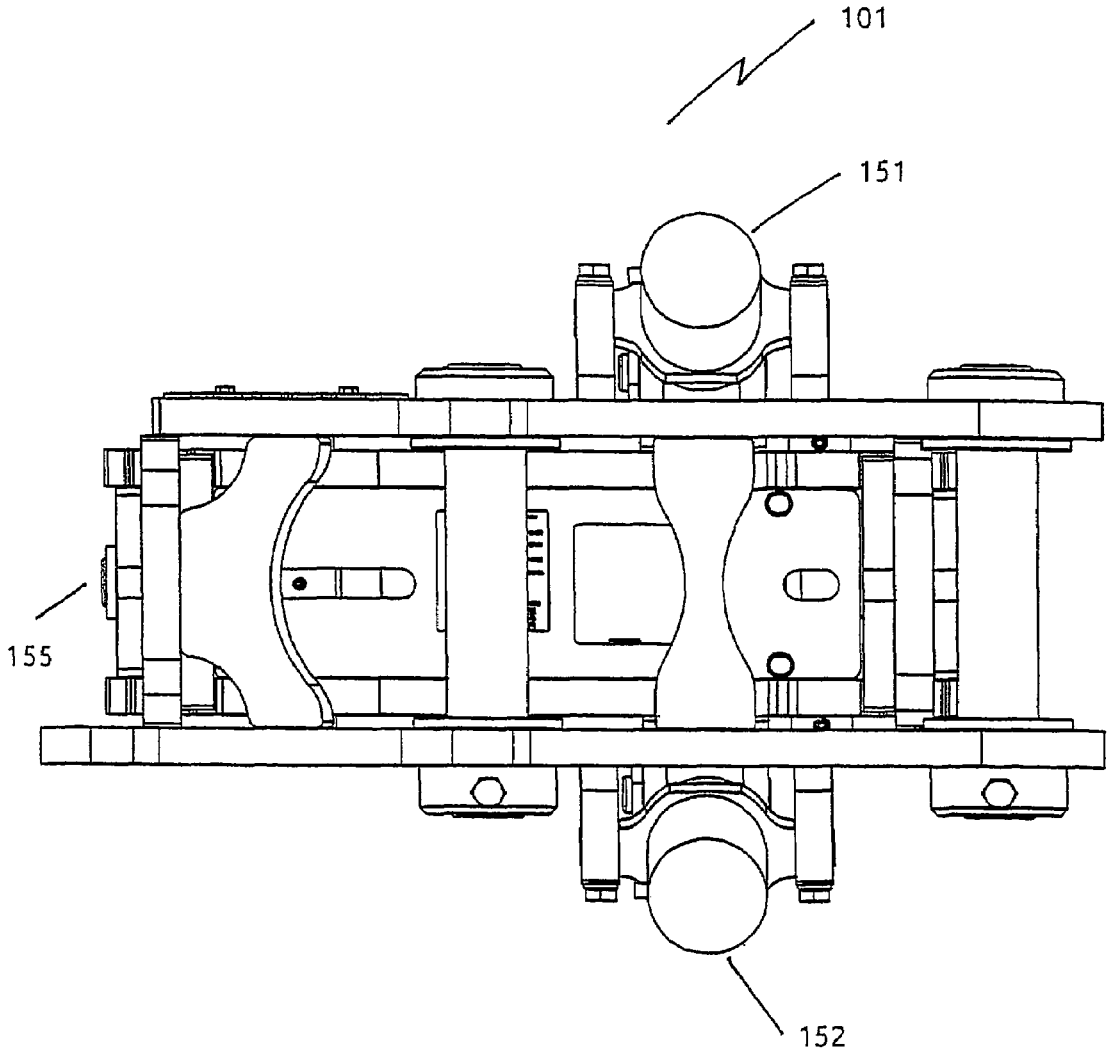
FIG. 9 is a plan view of a second embodiment of a quick attachment device according to the invention incorporating a tilting mechanism.
Figure 10:
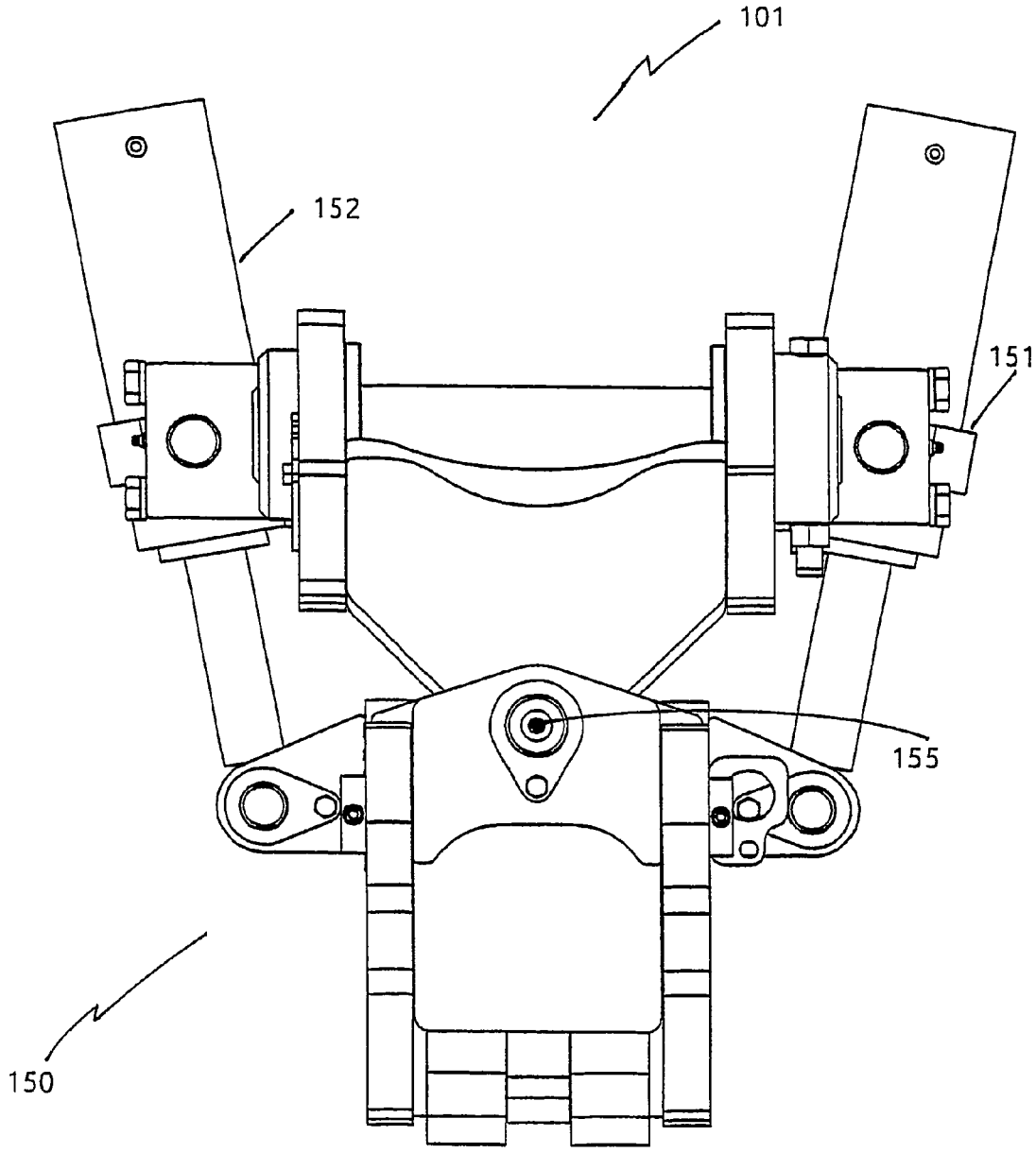
FIG. 10 is a first end view of the second embodiment.
Figure 11:
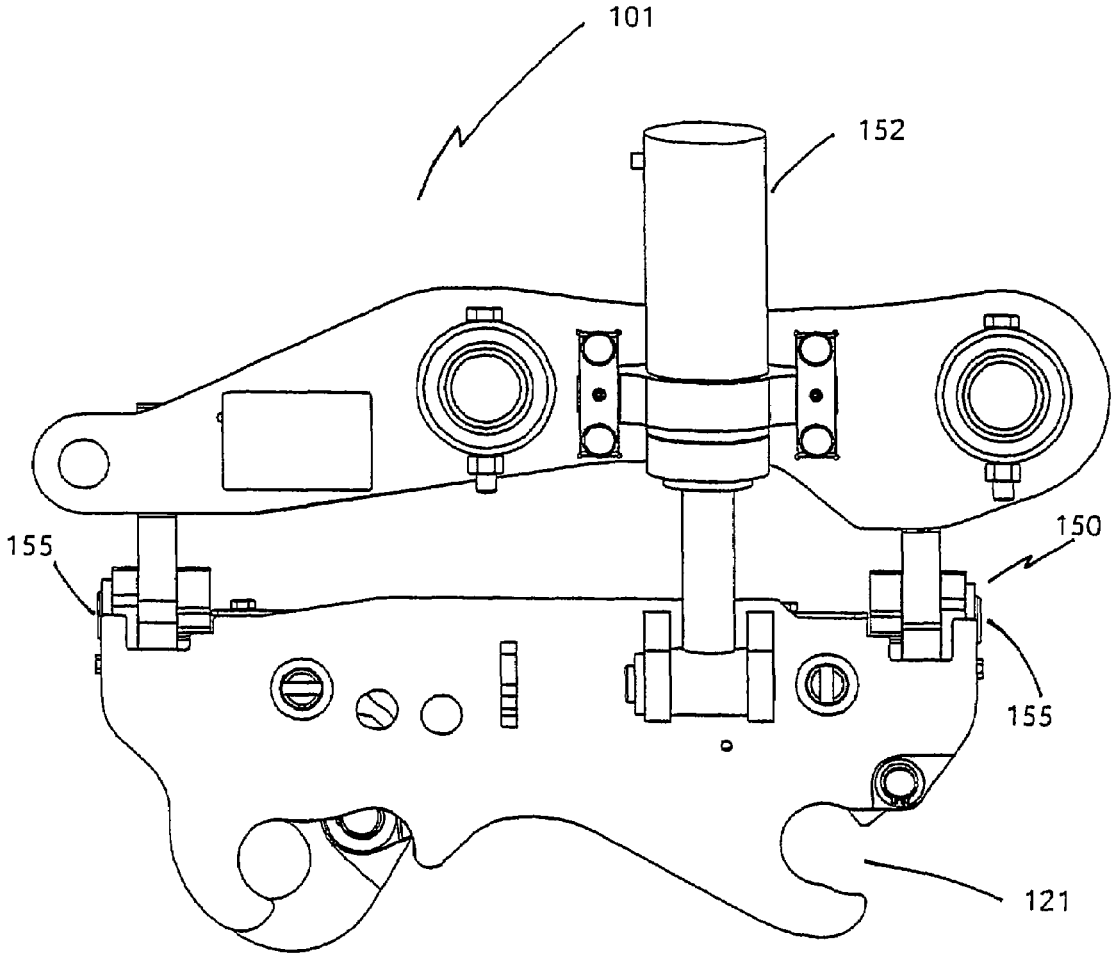
FIG. 11 is a side view of the second embodiment.
Figure 12:
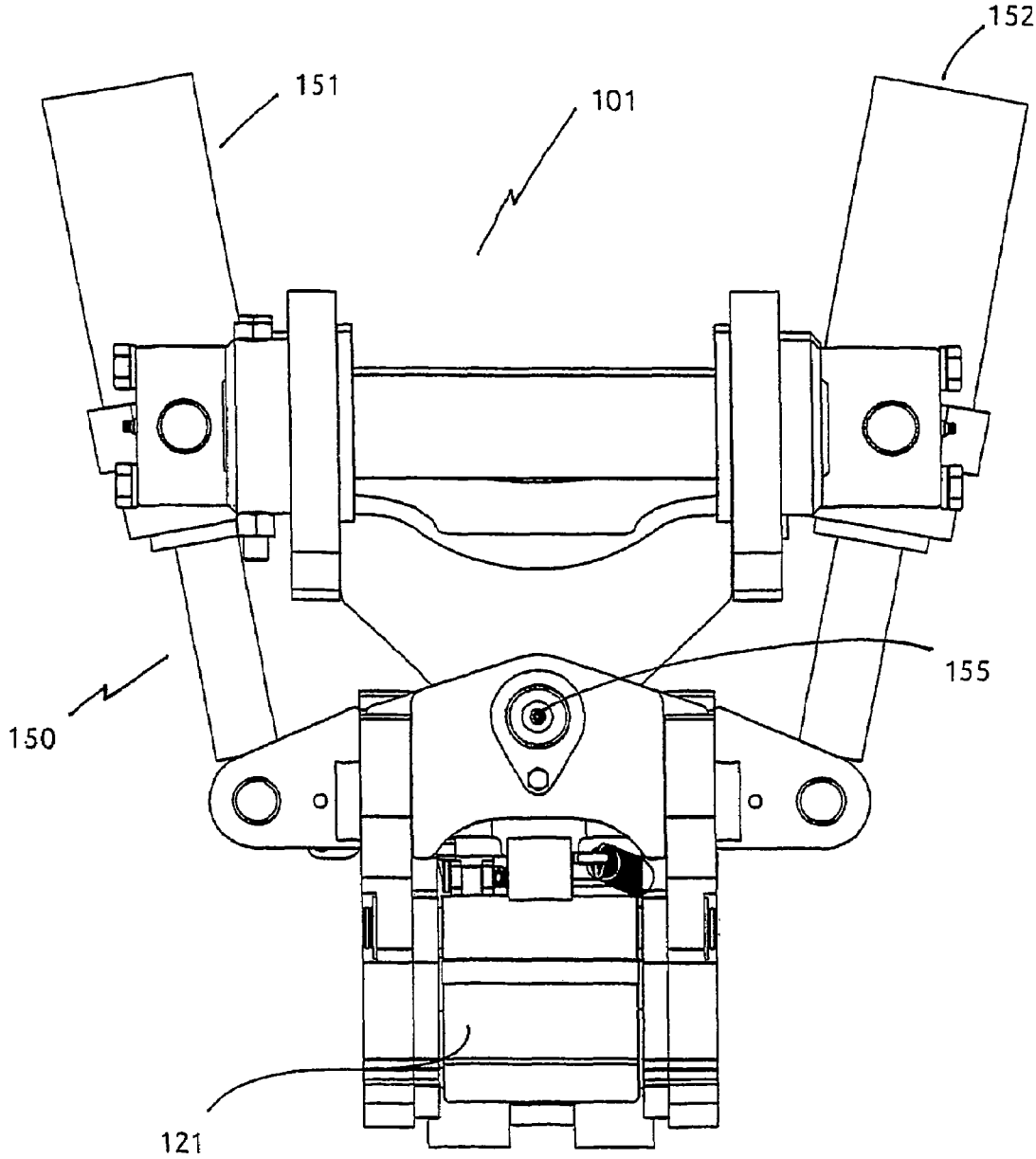
FIG. 12 is a second end view of the second embodiment.
Figure 13:
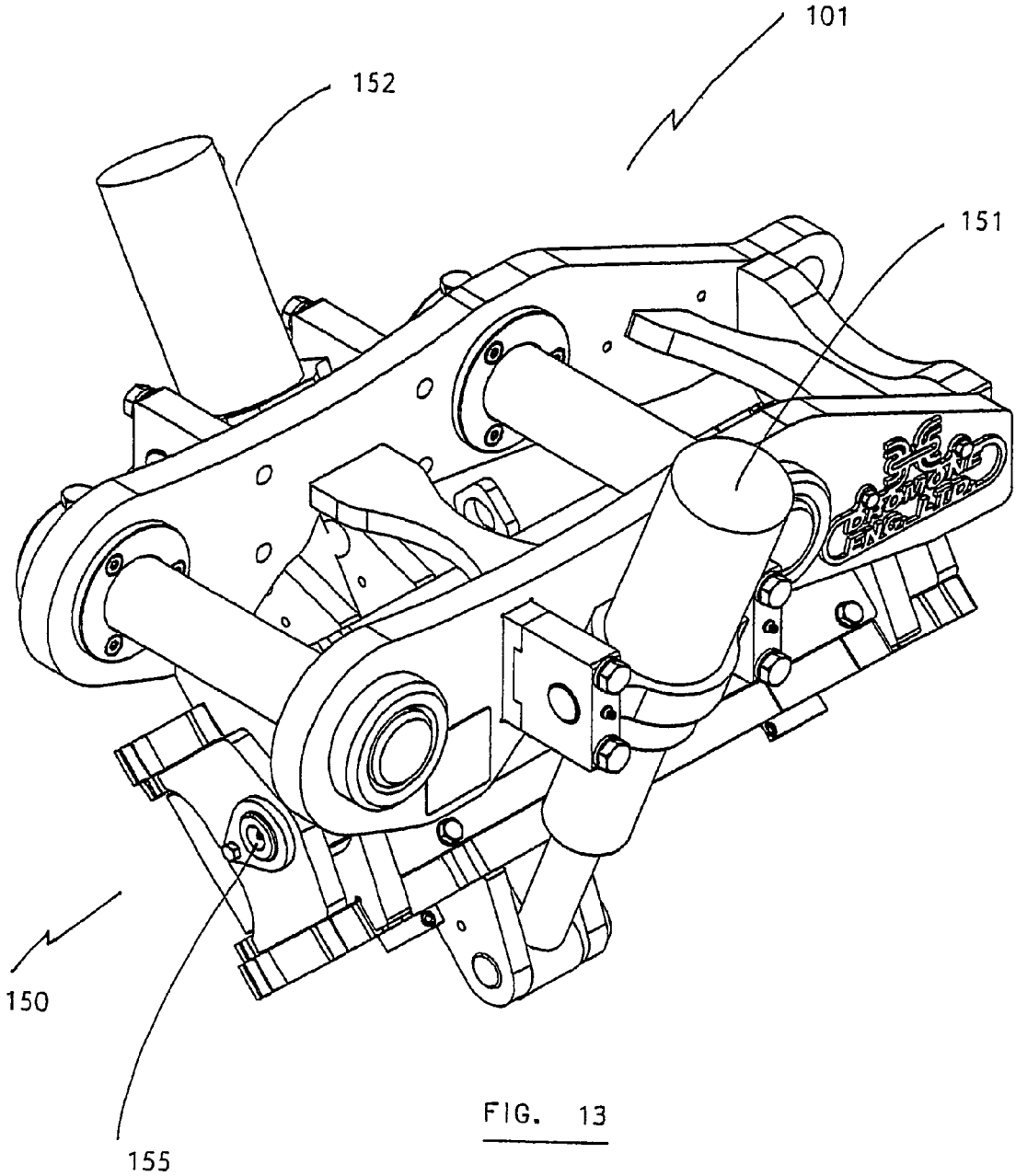
FIG. 13 is a perspective view of the second embodiment showing the mechanism tilted 45 degrees in one direction.
Figure 14:
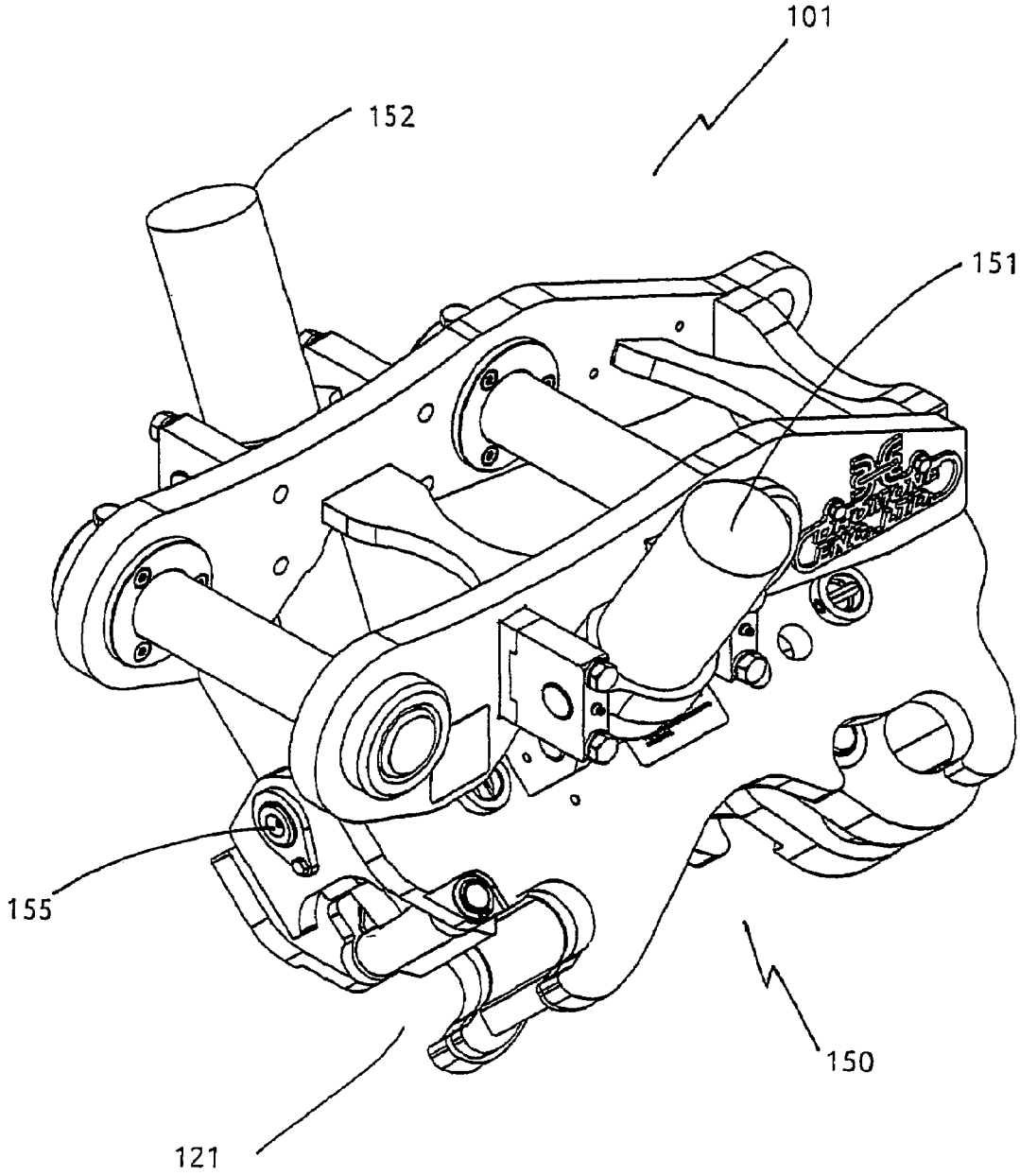
FIG. 14 is a further perspective view of the second embodiment showing the mechanism tilted 45 degrees in the opposite direction.
Figure 15:
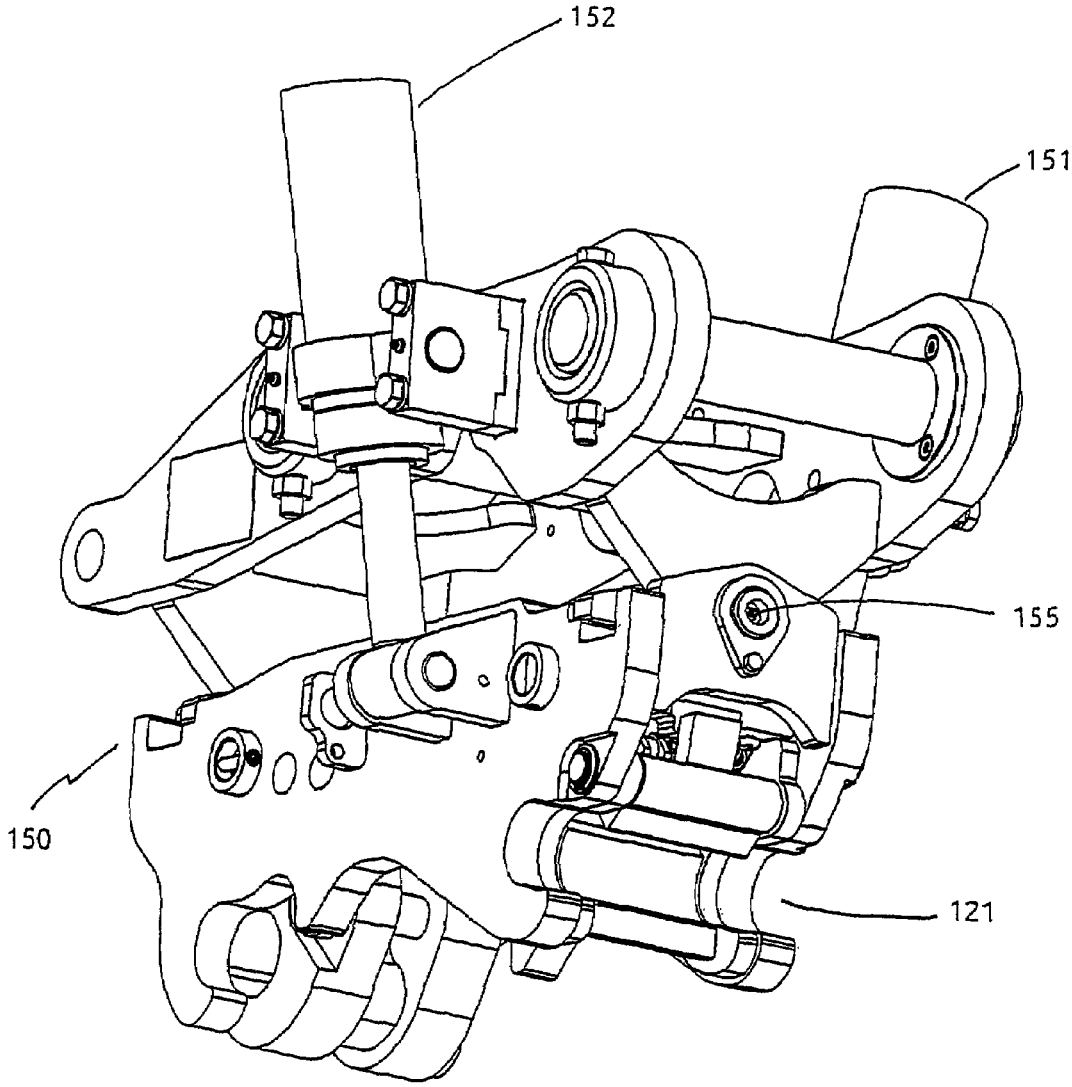
FIG. 15 is a lower perspective view of the second embodiment showing the mechanism in a non-tilted position.
Figure 16:
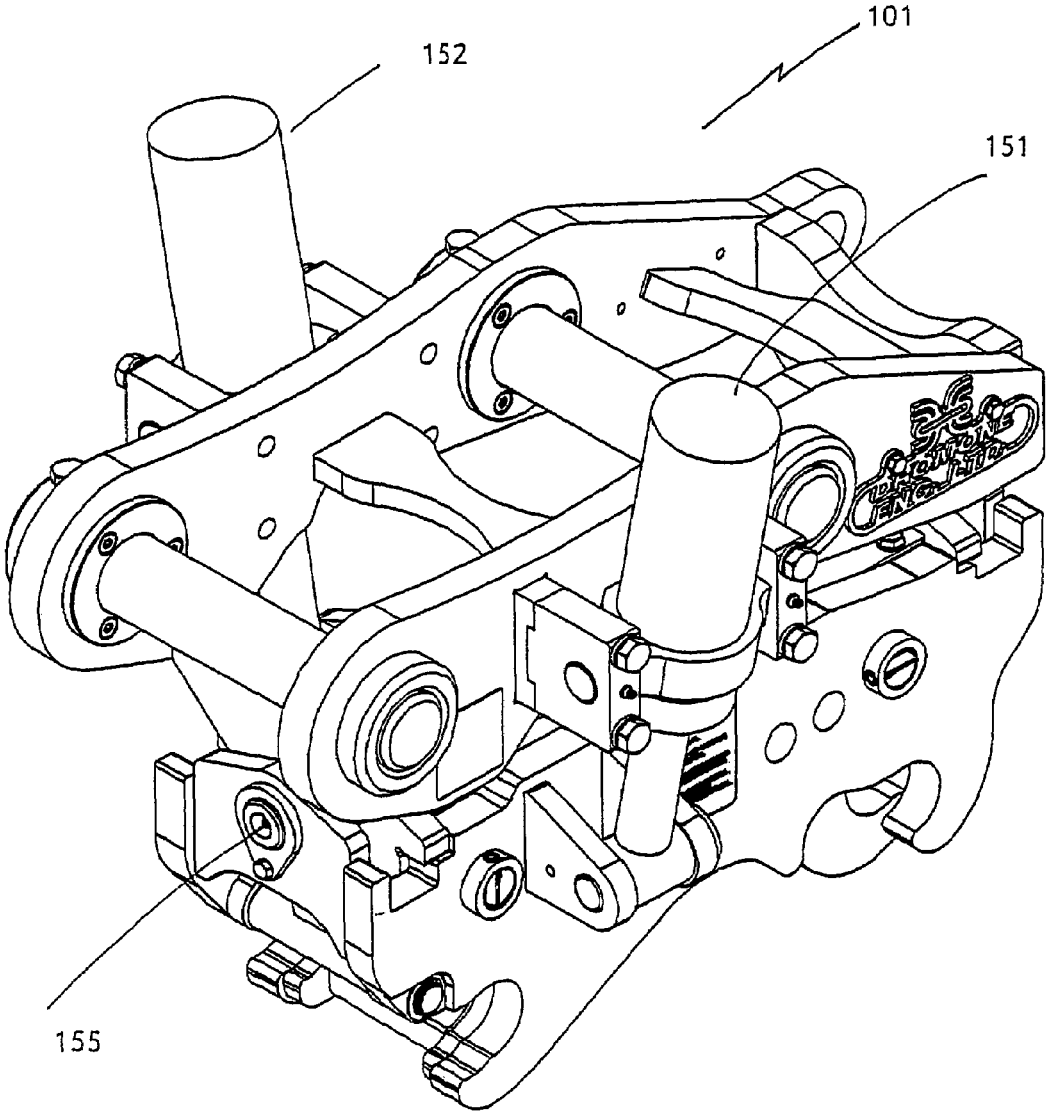
FIG. 16 is an upper perspective view of the second embodiment with the mechanism in the non-tilted position.

In FIG. 4 and FIG. 8, the hydraulic ram for operating the latch plates 3 has continued with its stroke forcing pin 29 to push first part 24 of the actuating assembly 23 against the lock 22 overcoming the biasing force of the spring. Lock 22 pivots about pin 42 and engaging bar 43 rotates away from mouth 14 of the attachment device 1. Both pins 11, 15 are no longer locked in the mouths 12, 14 and movement of the dipper arm 2 allows the tool to drop onto the ground.

Referring now to the second embodiment which is shown in FIGS. 9 to 15, the excavator tool quick attachment device 101 is provided with a safety mechanism 121 which is similar in construction and operation as the safety mechanism 21 of the first embodiment.

The excavator tool quick attachment device 101 additionally includes a tilt mechanism 150 by means of which the device can be tilted in two directions by approximately 45 degrees in each direction. The tilt mechanism 150 comprises two hydraulically operated cylinders 151 and 152 which can tilt the device about longitudinal central pivot 155.

With the device 101 fitted to an excavator it can be used for more versatile operations, for example, grading and digging work at an angle such as in ditches, dykes an drains. The operator can manoeuvre a tool around obstacles more readily within the device 101.

It will of course be understood that the invention is not limited to the specific details herein described, which are given by way of example only, and that various modifications and alterations are possible with the scope of the invention.

The invention claimed is:

1. An excavator tool quick attachment device for attaching a tool to a dipper arm of an excavator, the device comprising a body member with an engaging means at or about each end for engagement with two connecting pins disposed on a tool, the first engaging means being a movable engaging means, the device further comprising a drive means mounted between the body member and the movable engaging means for moving the movable engaging means between a tool pin engaging position and a tool pin releasing position, the second engaging means being a second movable engaging means normally biased into a tool pin engaging position by a biasing means, a control means mounted between the first movable engaging means and the second movable engaging means, wherein the control means acts on the second movable engaging means to overcome the biasing force only when the quick attachment device is inverted relative to a normal working position and the drive means is actuated, whereby the tool can not be released when it is in a normal working position in the event the drive means fails or is inadvertently actuated by an operator.

2. An excavator tool quick attachment device as claimed in claim 1, in which the control means comprises an adjustable length actuating assembly having a catch means to fix the length of the actuating assembly at a predetermined position when the quick attachment device is inverted relative to a normal working position and the drive means is actuated.

3. An excavator tool quick attachment device as claimed in claim 2, in which the actuating assembly is pivotally connected to both the first and second movable engaging means.

4. An excavator tool quick attachment device as claimed in claim 2, in which the actuating assembly is in two parts, the first part having a slot extending along a substantial portion of its longitudinal axis and the second part having two pins spaced apart along its length and extending laterally therefrom, the pins being formed for slidable engagement with the slot of the first part, allowing relative movement between the two parts, the pins movably holding the two parts together.

5. An excavator tool quick attachment device as claimed in claim 4, in which the catch means is provided by a notch on the slot which is located above the pins in any normal working position of the tool and the slot is located below the pins only when the quick attachment device is inverted relative to the normal working position, whereby when the quick attachment device is inverted and the drive means is actuated to move the first movable engaging means from a tool pin engaging position to a tool pin releasing position, the pins of the second part of the actuator assembly slide along the slot until the leading pin encounters the notch into which it drops under the force of gravity thereby fixing the length of the actuating assembly after which point continued stroke action of the drive means causes the actuating assembly to move the second movable engaging means away from the tool pin engaging position thereby releasing that tool pin.

6. An excavator tool quick attachment device as claimed in claim 1, in which the first movable engaging means is provided by a pair of latch hooks pivotally mounted on the body and in which the second movable engaging means is provided by a lock pivotally mounted on the body.

7. An excavator tool quick attachment device as claimed in claim 1, in which the drive means is a double acting piston and cylinder unit.

8. An excavator tool quick attachment device as claimed in claim 1, including a tilt mechanism by means of which the device can be tilted about a longitudinal pivotal axis.

* * * * *